US008156572B2

(12) United States Patent
Whaley

(10) Patent No.: US 8,156,572 B2
(45) Date of Patent: Apr. 17, 2012

(54) WEIGHTED EXERCISE CLOTHING

(76) Inventor: Patrick Gerald Whaley, Cumming, GA (US)

( * ) Notice: Subject to any disclaimer, the term of this patent is extended or adjusted under 35 U.S.C. 154(b) by 272 days.

(21) Appl. No.: 12/323,882

(22) Filed: Nov. 26, 2008

(65) Prior Publication Data

US 2009/0139005 A1 Jun. 4, 2009

Related U.S. Application Data

(60) Provisional application No. 60/991,008, filed on Nov. 29, 2007.

(51) Int. Cl.
*A41D 1/00* (2006.01)
*A41D 13/00* (2006.01)

(52) U.S. Cl. ..... 2/69; 2/228

(58) Field of Classification Search ..... 2/69, 77, 2/79, 94, 102, 108, 247, 115, 455, 456, 161.1, 2/227, 228, 238, 243.1, 67, 2.5; 482/105, 482/93, 94, 98, 99

See application file for complete search history.

(56) References Cited

U.S. PATENT DOCUMENTS

| | | | | |
|---|---|---|---|---|
| 2,241,833 | A * | 5/1941 | Waller | 482/105 |
| 5,048,125 | A * | 9/1991 | Libertini et al. | 2/79 |
| 5,868,652 | A * | 2/1999 | Spletzer | 482/105 |
| 5,937,441 | A * | 8/1999 | Raines | 2/69 |
| 5,951,446 | A * | 9/1999 | Monforte | 482/105 |
| 5,978,964 | A * | 11/1999 | Gaston | 2/69 |
| 6,209,135 | B1 * | 4/2001 | Irvin | 2/102 |
| 6,554,752 | B2 * | 4/2003 | Cook | 482/105 |
| 6,557,176 | B2 * | 5/2003 | Franco-Sion | 2/102 |
| 6,665,879 | B2 * | 12/2003 | VandenBerg | 2/102 |
| 2002/0184696 | A1 * | 12/2002 | Hochmuth | 2/160 |
| 2003/0092544 | A1 * | 5/2003 | Reed | 482/105 |
| 2004/0221355 | A1 * | 11/2004 | Garcia | 2/67 |
| 2006/0135326 | A1 * | 6/2006 | Virji et al. | 482/105 |
| 2006/0172870 | A1 * | 8/2006 | Virji | 482/105 |

* cited by examiner

*Primary Examiner* — Amy Vanatta

(74) *Attorney, Agent, or Firm* — Ryan A. Schneider, Esq.; Jihan A. R. Jenkins, Esq.; Troutman Sanders LLP

(57) ABSTRACT

A weighted article of clothing comprising a clothing substrate with weights attached thereto, the weights being made of a gel and being strategically placed so as to not interfere with the movements of a wearer and to not interfere with outer clothing or equipment worn over the weighted article of clothing and with the weights being arranged in a plurality of weight clusters and linking strands, with neighboring weight clusters being connected together with the linking strands.

22 Claims, 6 Drawing Sheets

WEIGHTED EXERCISE CLOTHING

STATEMENT OF RELATED APPLICATIONS

This patent application claims the benefit of U.S. Provisional Patent Application No. 60/991,008 having a filing date of Nov. 29, 2007, which is incorporated herein in its entirety by this reference.

BACKGROUND OF THE INVENTION

1. Technical Field

The present invention generally relates to exercise equipment and more specifically relates to weighted clothing for wearing during an exercise regimen.

2. Prior Art

In order to enhance the effects of a workout, some people, especially athletes, carry additional weights when exercising. For example, wrist and ankle weights are available for wearing bracelet-like and anklet-like to increase the strength and stamina of the arms and legs by requiring a user to exert extra effort when moving the arms or legs during running or other motion exercises. Members of the armed forces often wear weighted backpacks or backpacks containing weights when walking or hiking for increasing the strength and stamina of the legs and torso. Carrying such extra weight can increase the effort of the muscles, thus increasing the strength and stamina of the muscles upon continued use of the extra weights. Weighted clothing also exists for the same purpose. Wrist, ankle, backpack, and clothing weights, however, also have the potential of causing joint strain and damage.

U.S. Pat. No. 5,978,964 is a sportswear garment manufactured from a form-fitting clothing article having at least one flexible weight and a plurality of pockets to receive and maintain the weights in an immobile manner. U.S. Pat. No. 5,937,441 is a weighted suit to be used in athletic training, physical therapy, muscle toning and weight reduction. U.S. Pat. No. 5,048,125 is an article of apparel for use as athletic sportswear comprising a plurality of pockets that enclose flexible material of sufficient density to substantially increase the weight of the article.

U.S. Pat. No. 4,407,497 is a weighted exercise suit designed to enable human users to exercise with added weights removably attached to a body suit. U.S. Pat. No. 5,810,699 is an exercise vest that includes lower and intermediate rows of pockets extending along the outside of its back and side sections into which weights may be placed. U.S. Pat. No. 5,951,446 is a weighted conditioning garment to help an individual lose weight and/or increase muscle strength and stamina that includes a plurality of weight members affixed to at least two elongated flexible members formed in the shaped of an article of clothing.

U.S. Pat. No. 5,553,322 is a weighted exercising garment formed of one piece of resilient flexible material so as to be a snug fit on the wearer's body. U.S. Pat. No. 6,557,176 is a weight vest including a shell constructed of a plurality of panels defining a front and a back. U.S. Pat. No. 5,144,694 is an exercise or physical therapy apparel including a vest, pants, spine strap, belt, wrist bands, ankle bands and weight packets. U.S. Pat. No. 6,675,391 is a weight vest comprising a front portion and a back portion having pockets into which a plurality of weights having a cylindrical shape may be placed.

Although these prior art inventions may have some utility, they can be too restrictive and uncomfortable, do not advantageously circulate and re-distribute heat, and do not provide for a variety of workout techniques. For example, prior art garments may have short sleeves to dissipate heat, but do not allow for a shoulder workout or are too bulky to wear under football shoulder pads or other sports-related pads and uniforms. For another example, other prior art garments target isolated muscle groups for additional resistance, such as the shoulders, but do not provide additional weights to the arms and the legs. Additionally, prior art devices utilizing weighted elements, such as wrist and thigh weights, are not integrated into a garment and may impede the motion of the wrists, arms, and legs, thus restricting the movement of the athlete. Further, the prior art may comprise thick and bulky material that does not allow for breathing which can make a wearer overly hot and which is uncomfortable to wear while exercising. On the aesthetic side, the prior art designs may not be fashionable, and may utilize adjustment straps, which are difficult and time-consuming to fasten, and are likewise not fashionable.

Notwithstanding the prior art, there is a need for an integrated article of weighted clothing that can be worn on the torso, such as a shirt or pant, that is fashionable, flexible, breathable, and weighted yet does not interfere with other articles of clothing or the movement of the wearer. There also is a need for an article of weighted clothing that can be worn clandestinely underneath an outer garment without negatively affecting the aesthetics of the outer garment. It is to these needs and others that the present invention is directed.

BRIEF SUMMARY OF THE INVENTION

Briefly, the present invention is weighted clothing having a plurality of relatively small weights strategically attached to the substrate clothing such that the weighted clothing is comfortable to wear, does not interfere to any great extent with outer clothing or equipment such as pads, and does not interfere with the wearer's movement, yet provides sufficient extra weight and corresponding resistance so as to increase the strength and stamina of the wearer's muscles upon continued use of the weighted clothing.

The substrate clothing can be made of natural or synthetic materials, such as but not limited to cotton, nylon, polyester, LYCRA, SPANDEX, and combinations and blends. Use of a relatively thin breathable or wicking material such as nylon can add to the comfort of the wearer. Preferably, the material of manufacture of the substrate clothing is a lightweight, soft, breathable, comfortable material that can be elastic or contains elastic.

The weights can be made of a plurality of gel packets or solidified gel forms that can be sewn or otherwise adhered in known manners to the substrate clothing in strategic areas. The weights can also be enclosed in a two-layered material pocket formed in the substrate clothing. The use of a gel helps dissipate heat from the athlete keeping the athlete cooler and more comfortable, and helping prevent heat exhaustion and stroke. A relatively dense gel also can provide a greater weight per volume while also integrating structural support and cooling ability into the clothing. The weights can be interconnected to each other so as to eliminate the need for attachment straps.

The present invention also is a fashionable piece that can be worn under shoulder pads, padded pants, or any other apparatus, comfortably while providing extra weight and resistance for exercising the wearer's muscles and keeping the athlete cool.

The present invention also can apply weight resistance with external support thereby taking strain off of the joints, which is an improvement over the known prior art wrist and ankle weights. Whereas wrist and ankle weights apply centrifugal forces to the wearer's joints, the weighted clothing of the present invention absorbs the centrifugal forces of the weights, thereby taking strain off of the joints. As such, the present invention can be a health solution to the exercise dilemma of adding weight versus straining joints.

The substrate clothing can have the general shape of a common tee-shirt for the upper torso or a common athletic short for the lower torso. Preferably, the substrate clothing is a long-sleeved shirt such that weights can be strategically placed proximal to any portion of the wearer's upper torso. Similarly, preferably, the substrate clothing is an athletic pant that extends at least partway down the wearer's thighs such that weights can be strategically placed proximal to any portion of the wearer's lower torso and upper legs. Long pants also are contemplated to provide weights strategically proximal to the wearer's entire leg.

In one illustrative embodiment of the present invention, the weighted garment is worn underneath athletic uniforms and equipment, such as football pads, during practice sessions to increase resistance applied to a wearer's muscles and maximize the efficiency of a workout. As such, this embodiment of the invention preferably is relatively thin so as to not interfere with the function of the pads and the movement of the wearer. In another illustrative embodiment of the present invention, the weighted garment is worn under common exercise or weightlifting clothing. As such, this embodiment of the invention also preferably is relatively thin so as not to interfere with the exercise motion or the aesthetics of the common exercise clothing. In yet another illustrative embodiment of the invention, the weighted garment itself is worn as the exercise clothing. As such, this embodiment preferably presents pleasing aesthetic qualities as well as the stated functionality.

Other features, aspects, and advantages of the invention will become apparent from the following detailed description of the preferred embodiments, taken in conjunction with the accompanying drawings in which like reference numerals represent like components throughout the several views, illustrating by way of example the principles of the invention.

DETAILED DESCRIPTION OF THE PREFERRED EMBODIMENTS

The following detailed description of preferred embodiments is presented only for illustrative and descriptive purposes and is not intended to be exhaustive or to limit the scope and spirit of the invention. The embodiments were selected and described to best explain the principles of the invention and its practical applications. One of ordinary skill in the art will recognize that many variations can be made to the invention disclosed in this specification without departing from the scope and spirit of the invention.

Figure 1:
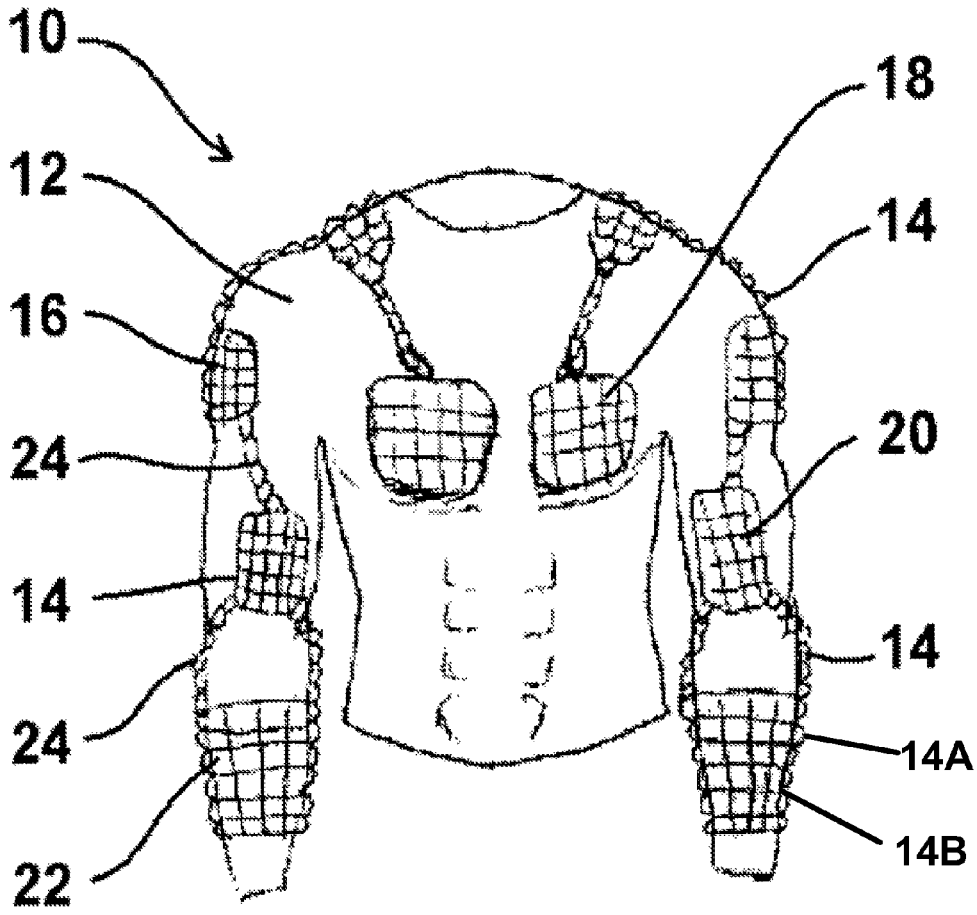
FIG. 1 is a perspective view of the front of a first embodiment of the invention showing an upper-torso covering garment.
Figure 2:
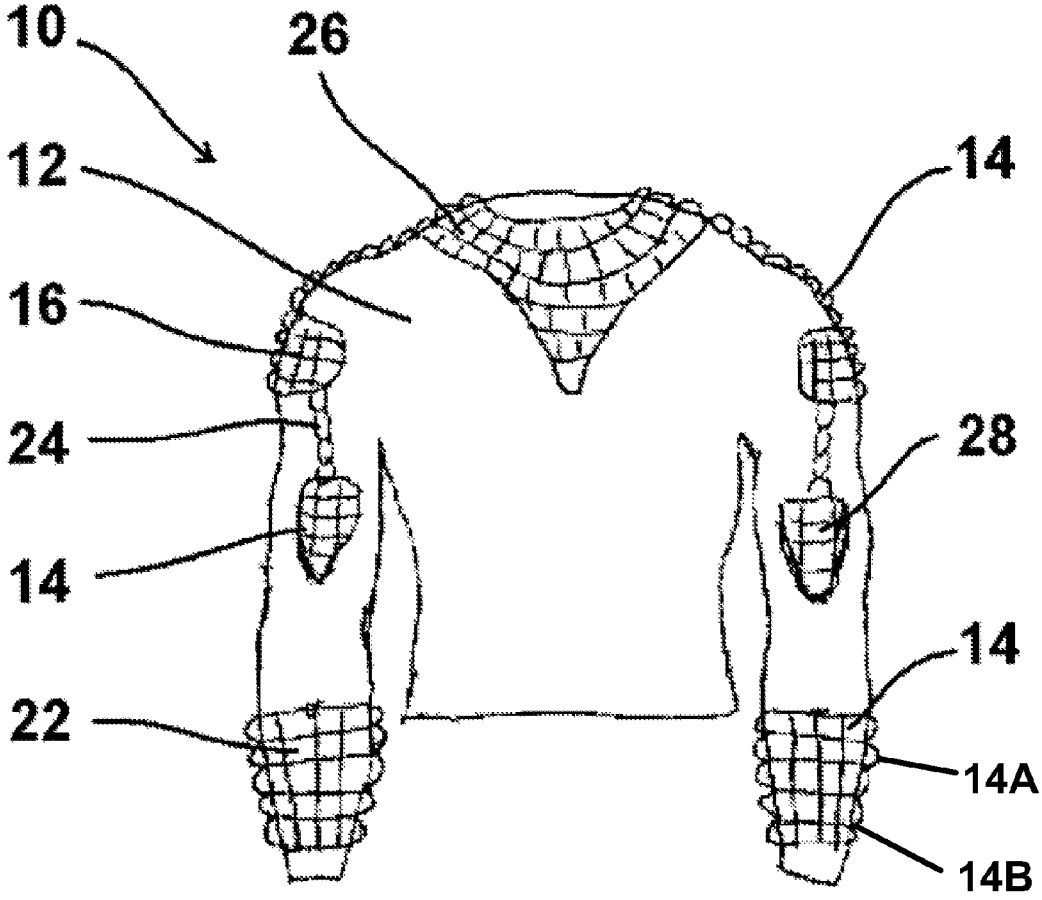
FIG. 2 is a perspective view of the back of a first embodiment of the invention showing an upper-torso covering garment.
Figure 3:
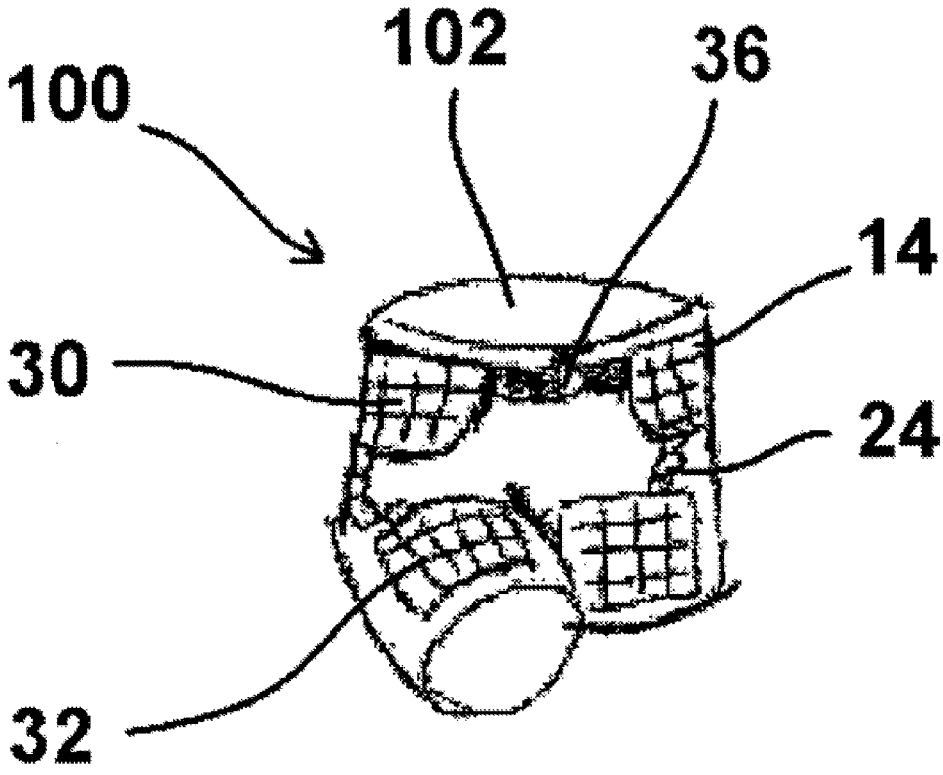
FIG. 3 is a perspective view of the front of a second embodiment of the invention showing a lower-torso covering garment.
Figure 4:
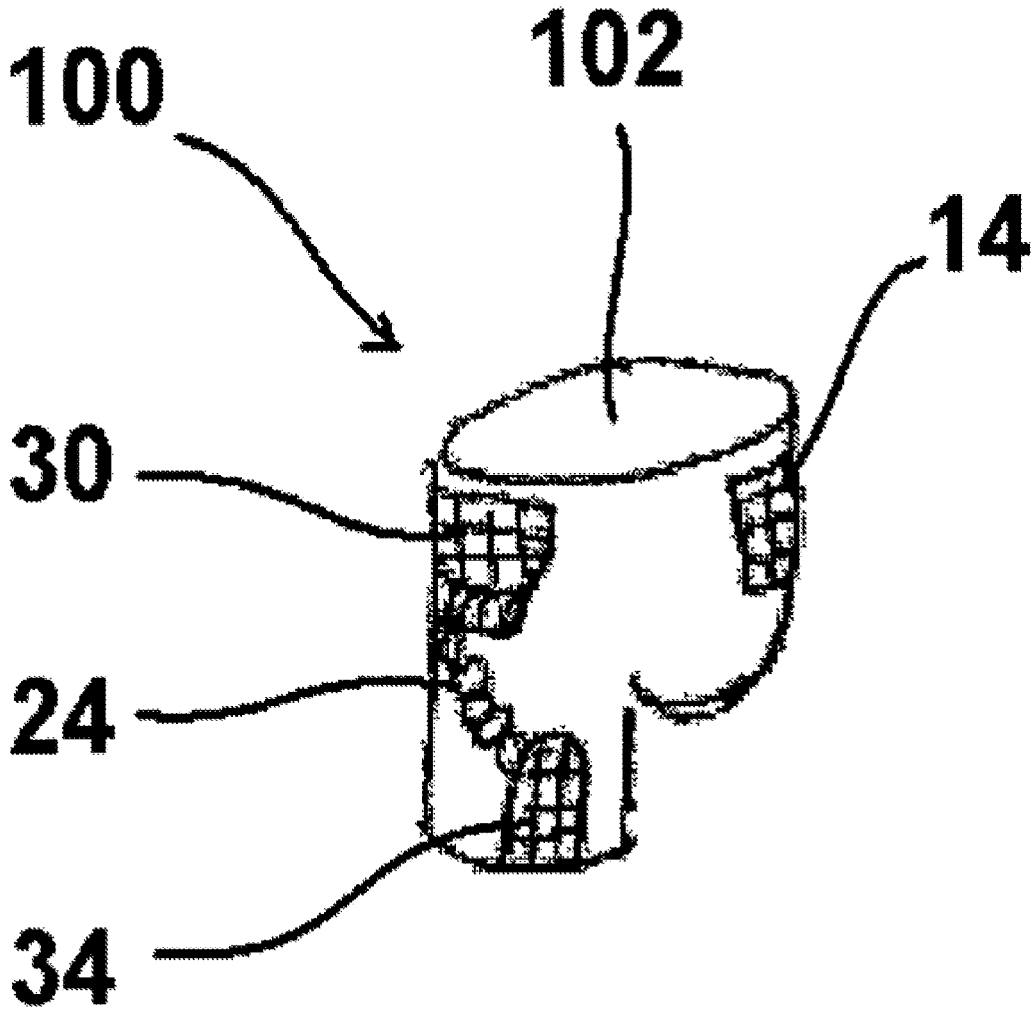
FIG. 4 is a perspective view of the back of a second embodiment of the invention showing a lower-torso covering garment.
Figure 5:
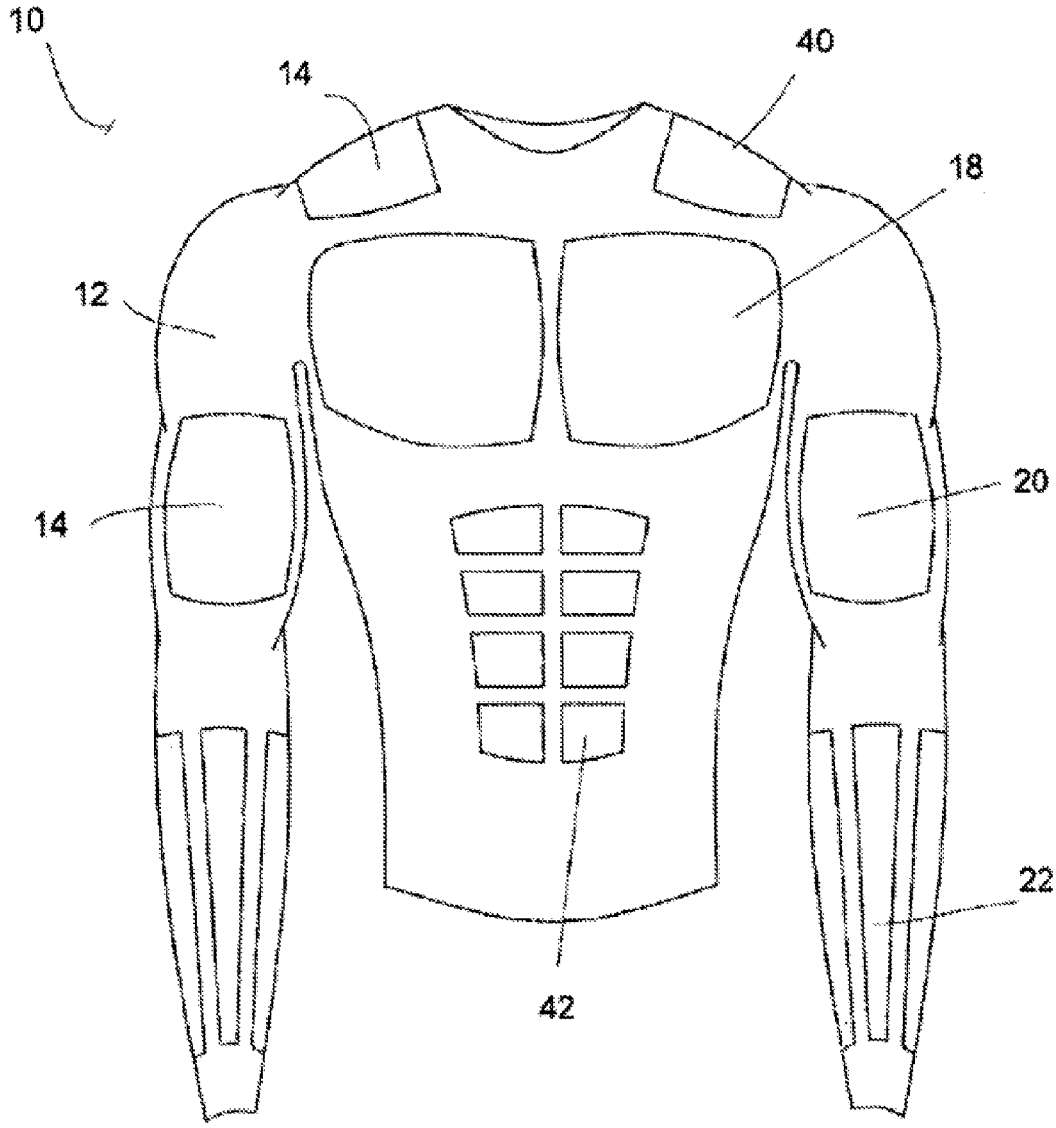
FIG. 5 is a perspective view of the front of a third embodiment of the invention showing an upper-torso covering garment and further detailing illustrative shape and placement of weighted pads.
Figure 6:
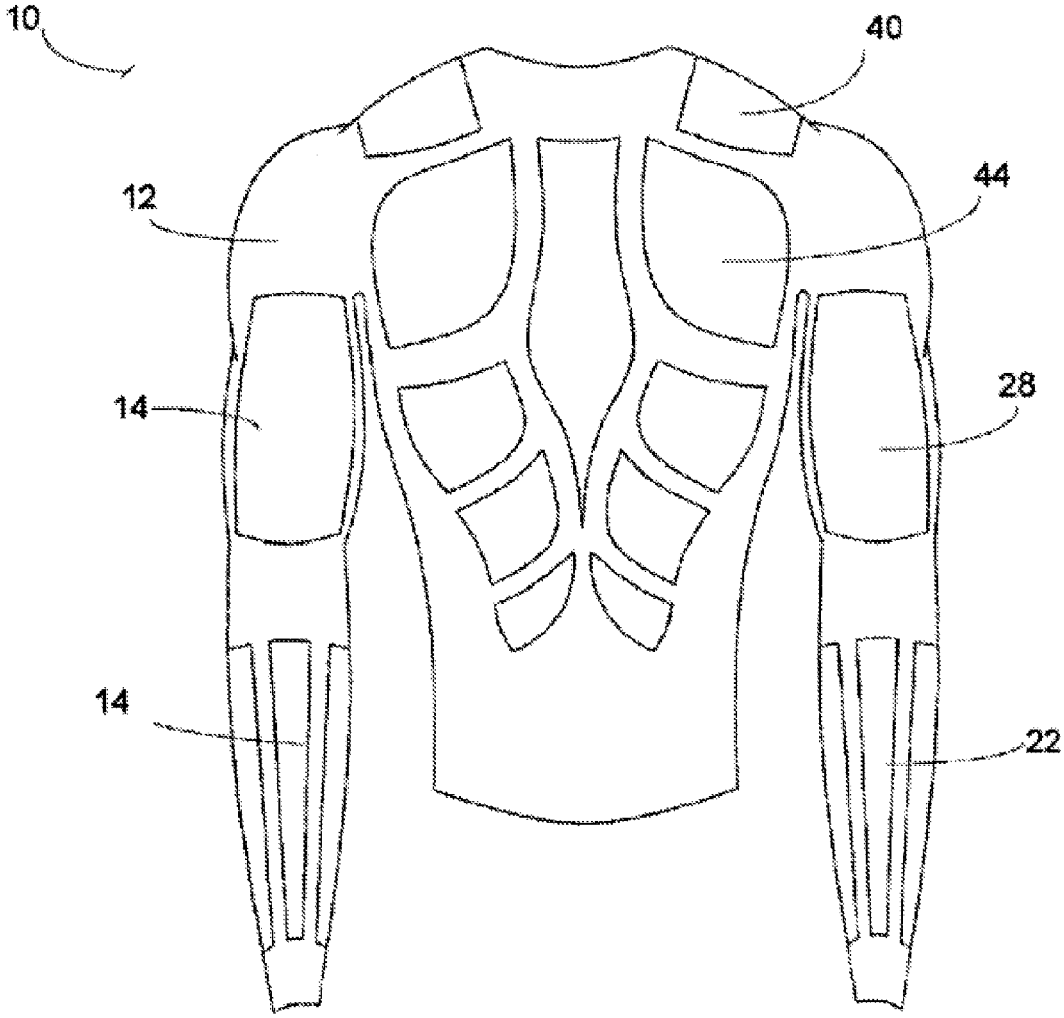
FIG. 6 is a perspective view of the back of a third embodiment of the invention showing an upper-torso covering garment and further detailing illustrative shape and placement of weighted pads.

Illustrative embodiments of a weighted garment for providing additional resistance to the muscles of a wearer and maximizing the effects and efficiency of a workout are shown in FIGS. 1 through 6. FIG. 1 is a perspective view of the front of a first embodiment of the invention, namely a shirt, showing an illustrative placement of the weights on the front of the shirt. FIG. 2 is a perspective view of the back of the first embodiment of the invention also showing an illustrative placement of the weights on the back of the shirt. FIG. 3 is a perspective view of the front of a second embodiment of the invention, namely pants, showing an illustrative placement of the weights on the front of the pants. FIG. 4 is a perspective view of the back of the second embodiment of the invention also showing an illustrative placement of the weights on the back of the pants. FIG. 5 is a perspective view of the front of a third embodiment of the invention showing another illustrative placement and shape of the weights on the front of the shirt. FIG. 6 is a perspective view of the back of a third embodiment of the invention showing another illustrative placement and shape of the weights on the back of the shirt.

The present invention is weighted clothing having multiple small weights with strategic shape and placement on substrate clothing. The present invention applies additional resistance to corresponding muscles, maximizing the effect and efficiency of a user's workout. The garment is low-profile, sleek and streamlined so as not to be overly bulky or to obstruct a user's movements and yet to remain aesthetically pleasing. The present invention is suitable for use in conjunction with cardiovascular exercise, weightlifting, calisthenics, yoga, sports training, physical therapy, and other physical activities. Currently, there is a need for weighted exercise garments that are comfortable, breathable, easy to use, stylish, and do not interfere with other garments or the physical movements of a user.

Referring now to the figures, the present invention is weighted clothing 10, 100 having a plurality of relatively small weights 14 strategically attached to the substrate clothing 12, 102 such that the weighted clothing 10, 100 is comfortable to wear and stylish, does not interfere to any great extent with outer clothing or equipment such as protective football pads, and does not interfere with the wearer's movement, yet provides sufficient extra weight and resistance so as to increase the strength and stamina of the wearer's muscles upon continued use of the weighted clothing 10, 100.

FIG. 1 is a perspective view of the front of a first embodiment of the invention, namely a weighted shirt 10, showing an illustrative placement and shape of the weights 14 on the front of the weighted shirt 10. The illustrative substrate shirt 12 has the shape of a common long-sleeved tee-shirt or fitted athletic shirt. Weights 14 can be strategically placed on the substrate shirt 12 such that the weights 14 are proximal to any portion of the wearer's upper torso. In the illustrative embodiment shown in FIG. 1, the weights 14 are shown attached to the front of the substrate shirt 12 as a shoulder weight cluster 16, a pectoral weight cluster 18, a bicep weight cluster 20, and a forearm weight cluster 22. The placement of the weights 14 thus corresponds to an underlying muscle group. Linking strands 24 of weights can connect the various weight clusters 16, 18, 20, 22 so as to maintain the weight clusters 16, 18, 20, 22 in place without the need for additional attachment straps.

Linking strands 24 also help distribute the weight of the weight clusters 16, 18, 20, 22 to maintain the integrity and longevity of the garment and to effectuate a full-body workout. Additional weight clusters can be attached to the substrate shirt 12 as necessary or desired, especially to connect with target muscle groups or to accommodate the anatomy, needs, and sex of a wearer.

Referring now to FIG. 2, a perspective view of the back of the first embodiment of the invention shows illustrative placement of the weights 14 on the back of the shirt 10. In the illustrative embodiment shown in FIG. 2, the weights 14 are shown attached to the substrate shirt 12 as a neck weight cluster 26, a shoulder weight cluster 16, a triceps weight cluster 28, and a forearm weight cluster 22. A linking strand 24 is not necessary between the triceps weight cluster 28 and the forearm weight cluster 22 on the back of the shirt 10 due to the presence of a linking strand 24 between the bicep weigh cluster 20 and the forearm weight cluster 22 on the front of the shirt 10. Additional and interchangeable linking strands 24, however, may be strategically placed to achieve a desired distributive effect on target muscle groups.

The specific illustrative embodiment shown in FIGS. 1 and 2 is optimized for wearing under athletic equipment such as football shoulder pads or lacrosse or hockey protective gear. Specifically, the weight clusters 16, 18, 20, 22, 26, 28 are placed on the substrate shirt 12 so as not to interfere with the placement of the protective gear on the wearer. Even more specifically, the weight clusters 16, 18, 20, 22, 26, 28 are placed on the substrate shirt 12 in areas that football shoulder pads do not place a significant amount of pressure. Various other illustrative shirt embodiments of the invention 10 can be designed by those of ordinary skill in the art for use in connection with other types of pads, with various uniforms, and with no pads or uniforms. In general, in embodiments of the invention such as represented by FIGS. 1 and 2, the weight clusters 16, 18, 20, 22, 26, 28 are strategically placed so as not to interfere with the joints, thus allowing a greater freedom of motion.

FIG. 3 is a perspective view of the front of a second embodiment of the invention, namely weighted pants 100, showing an illustrative placement of the weights 14 on the front of the weighted pants 100. The illustrative substrate pants 102 are a fitted short or athletic pant that extends at least partway down the wearer's thighs such that weights 14 can be strategically placed proximal to any portion of the wearer's lower torso and upper legs. Long pants (not shown) also are contemplated to provide weights 14 strategically proximal to the wearer's entire leg. In the illustrative embodiment shown in FIG. 3, the weights 14 are shown attached to the front of the substrate pants 102 as a hip weight cluster 30 and a thigh weight cluster 32. Linking strands 24 of weights can connect the various weight clusters 30, 32 so as to maintain the weight clusters 30, 32 in place and to effectuate a full-body workout without the need for additional attachment straps. Additional weight clusters can be attached to the substrate pants 102 as necessary or desired, depending on the preferred amount and placement of resistance, especially to connect with target muscle groups or to accommodate the anatomy, needs, and sex of a wearer. A belt 36 can be fed underneath the weight cluster in a typical material channel in a known manner to provide additional support.

FIG. 4 is a perspective view of the back of the second embodiment of the invention also showing an illustrative placement of the weights 14 on the back of the pants 100. In the illustrative embodiment shown in FIG. 4, the weights 14 are shown attached to the substrate pants 102 as a hip weight cluster 30 and a hamstring weight cluster 34.

The specific illustrative embodiment shown in FIGS. 3 and 4 is optimized for wearing under padded football pants. Specifically, the weight clusters 30, 32, 34 are placed on the substrate pants 102 so as not to interfere with the placement of the football thigh pads on the wearer. Even more specifically, the weight clusters 30, 32, 34 are placed on the substrate pants 102 in areas that the football thigh pads do not place a significant amount of pressure. Various other illustrative pants embodiments of the invention 100 can be designed by those of ordinary skill in the art for use in connection with other types of pads, with various uniforms, and with no pads or uniforms. In general, in embodiments of the invention such as represented by FIGS. 3 and 4, the weight clusters 30, 32, 34 are strategically placed so as not to interfere with the joints, thus allowing a greater freedom of motion.

FIG. 5 is a perspective view of the front of a third embodiment of the invention, namely a weighted shirt 10, showing an alternative illustrative placement and shape of the weights 14 on the front of the weighted shirt 10. The illustrative substrate shirt 12 also has the shape of a common long-sleeved fitted athletic shirt, similar to that shown in FIGS. 1 and 2. Weights 14 are adhered, sewn, or attached by known means in strategic locations on the substrate shirt 12 such that the weights 14 are proximal to any portion of the wearer's upper torso. In the illustrative embodiment shown in FIG. 5, the weights 14 are shown attached to the front of the substrate shirt 12 as a trapezius weight cluster 40, a pectoral weight cluster 18, a bicep weight cluster 20, a forearm weight cluster 22, and an abdominal weight cluster 42. The placement of the weights 14 thus corresponds to an underlying muscle group. Linking strands 24 are not needed, as in the first and second illustrative embodiments, in part because of the lower profile yet higher density of the weights 14 within the fitted substrate shirt 12, and the high surface area coverage of the shape of the weights 14 in this illustrative embodiment which helps to maintain the integrity and longevity of the garment.

Referring now to FIG. 6, a perspective view of the back of the third embodiment of the invention shows illustrative placement of the weights 14 on the back of the shirt 10. In the illustrative embodiment shown in FIG. 6, the weights 14 are shown attached to the substrate shirt 12 as a back weight cluster 44, a trapezius weight cluster 40, a triceps weight cluster 28, and a forearm weight cluster 22. Additional weights 14 may be strategically placed to achieve desired resistance to target muscle groups.

The specific illustrative embodiments shown in FIGS. 5 and 6 are also optimized for wearing under athletic equipment such as football shoulder pads or lacrosse or hockey protective gear. In addition, due to their anatomically correct placement, and the shape and profile of the weight clusters 18, 20, 22, 28, 40, 42, 44, the weights 14 do not interfere with the physical motion of a wearer. The spaces between the weight clusters 18, 20, 22, 28, 40, 42, 44 allow for natural flexibility and movement of the substrate shirt 12 unimpeded by any added mass or thickness. Further, the weight clusters 18, 20, 22, 28, 40, 42, 44 do not place undue pressure on a wearer when used in conjunction with athletic gear or when performing exercises that involve technical movements or flexibility, like yoga or weightlifting. Further, this illustrative embodiment is not bulky so as to inhibit a user from wearing the garment underneath other athletic clothing. In fact, the anatomical placement and shape of the weights 14 is aesthetically pleasing and may enhance the look of wearer either when the garment is worn alone or underneath another garment.

The substrate clothing 12, 102 can be made of natural or synthetic materials, such as but not limited to cotton, nylon, polyester, LYCRA, SPANDEX, and combinations and blends. Use of a relatively thin breathable or wicking material such as nylon can add to the comfort of the wearer. Preferably, the material of manufacture of the substrate clothing 12, 102 is a lightweight, soft, comfortable material that can be elastic or contains elastic such that the material is form-fitting.

The weights 14 can be made of a plurality of gel packets or solidified gel forms, both of which are referred to herein as gel packets 14A, that can be sewn, attached with adhesives, attached by melting, or otherwise adhered to the substrate clothing 12, 102 in strategic areas. In one embodiment, various smaller gel packets 14A, shown as squares in the figures, are attached together to form the various weight clusters 16, 18, 20, 22, 26, 28, 30, 32, 34 and the linking strands 24. In another embodiment, a larger gel packet 14A having the general shape of each of the weight clusters 16, 18, 20, 22, 26, 28, 30, 32, 34 and the linking strands 24 can be formed or scored to have thinner areas 14B for flexibility. In another embodiment, the gel packets 14A are placed within an outer covering or pocket for containing the gel packets 14A. Although it is preferable that the weights 14, and therefore the gel packets 14A, be as thin as possible to prevent interference with other clothing and with the wearer's actions, the weights 14 can be made thicker or thinner depending on the density of the gel and the weight desired.

Suitable gels are known in the art and preferably are non-toxic, non-staining, and hypoallergenic. Solid gels are preferred to prevent leaking and loss of gel; however, liquid gels can be used if contained in a suitable containment outer layer. The use of a gel can dissipate heat from the athlete keeping the athlete cooler and more comfortable, and helping prevent heat exhaustion and stroke. Further, a gel can also serve as a shock absorber to protect a wearer from impact injury, such as might occur in football, hockey, and any number of sports. A relatively dense gel also can provide a greater weight per volume while also integrating structural support and cooling ability into the clothing 10, 100. The weights 14 can be interconnected to each other so as to eliminate the need for attachment straps.

One embodiment of the present invention is to wear underneath athletic uniforms and equipment, such as football pads, during practice sessions. As such, this embodiment of the invention preferably is relatively thin so as to not interfere with the function of the pads. Another embodiment of the invention is to wear under common exercise clothing. As such, this embodiment of the invention also preferably is relatively thin so as not to interfere with the exercise motion or the aesthetics of the common exercise clothing. Another embodiment of the invention is to wear as the exercise clothing. As such, this embodiment preferably is made aesthetically pleasing in and of itself. The present invention also is a fashionable piece that can be worn under shoulder pads, padded pants, or any other apparatus, comfortably while providing the extra weight for exercising the wearer's muscles, keeping the athlete cool, and providing a distributive effect to redirect forces upon muscles and muscle groups.

The wearing of the weighted clothing 10, 100 is determined by its structure. Because of the described features of the weighted clothing 10, 100 a wearer can easily and quickly put on the clothing in a manner similar to putting on a common tee-shirt or athletic pants. It is understood by persons of ordinary skill in the art that the optimal dimensions, sizes, and materials for the invention depend on the size of the wearer, manufacturing materials, and aesthetics or design of the outer garment, just like any other piece of clothing. Such parameters for the present invention can be determined without undue experimentation.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

What is claimed is:

1. A weighted article of clothing comprising a clothing substrate with weights attached thereto, the weights being made of a gel and being strategically placed so as to not interfere with the movements of a wearer, wherein at least a portion of the weights are arranged in at least two weight clusters and at least one weighted linking strand therebetween, the at least one weighted linking strand comprising a portion of the clothing substrate and one or more of the weights, and the width of the at least one weighted linking strand being less than the width of the at least two weight clusters.

2. The weighted article of clothing of claim 1, wherein the weights are arranged in a plurality of weight clusters and weighted linking strands, with neighboring weight clusters being connected together with the weighted linking strands.

3. The weighted article of clothing of claim 1, wherein the weights are further strategically placed so as not to interfere with outer clothing or equipment worn over the weighted article of clothing.

4. The weighted article of clothing of claim 1, wherein said weights are contained within pockets in the clothing substrate.

5. The weighted article of clothing of claim 2, further comprising spaces between the plurality of weight clusters corresponding to a human anatomical space between muscles.

6. The weighted article of clothing of claim 1, wherein at least a portion of the clothing substrate is breathable.

7. The weighted article of clothing of claim 1, wherein the at least one weighted linking strand maintains at least one weight substantially in place with respect to the body of a person wearing the weighted article of clothing when the person moves.

8. The weighted article of clothing of claim 1, wherein the at least one weighted linking strand comprises thinned areas that allow for flexibility of the linking strand.

9. A weighted article of clothing comprising a clothing substrate with weights attached thereto, the weights being made of a gel and being strategically placed so as to not interfere with outer clothing or equipment worn over the weighted article of clothing, wherein at least a portion of the weights are arranged in a plurality of weight clusters, wherein at least one weight cluster is linked to another weight cluster via a weighted linking strand, and wherein the width of the weighted linking strand is less than the width of the weight clusters it links.

10. The weighted article of clothing of claim 9, wherein the weights are further strategically placed so as not to interfere with the movements of a wearer.

11. The weighted article of clothing of claim 9, wherein said weights are contained within pockets in the clothing substrate.

12. The weighted article of clothing of claim 9, further comprising spaces between the plurality of weight clusters corresponding to a human anatomical space between muscles.

13. The weighted article of clothing of claim 9, further comprising a support belt.

14. The weighted article of clothing of claim 9, wherein the weighted linking strand maintains at least one weight cluster substantially in place with respect to the body of a person wearing the weighted article of clothing when the person moves.

15. A weighted article of clothing comprising a clothing substrate with a plurality of weights attached thereto, the weights being made of a thin, solidified gel and being strategically placed adjacent to one or more of a wearer's corresponding muscle groups such that increased resistance is applied to said muscle group when a wearer undertakes physical activity, wherein at least one weighted linking strand connects at least two of the weights, and wherein the width of the at least one weighted linking strand is less than the width of the weights it connects.

16. The weighted article of clothing of claim 15, wherein said weights are shaped to contact the clothing substrate with maximum surface area such that said weights adhere naturally to the anatomy of a wearer and such that the longevity and integrity of the article of clothing is maintained.

17. The weighted article of clothing of claim 15, wherein the weights are further strategically placed so as not to interfere with the movements of a wearer.

18. The weighted article of clothing of claim 15, wherein said weights are contained within pockets in the clothing substrate.

19. The weighted article of clothing of claim 15, further comprising spaces between the plurality of weight clusters corresponding to a human anatomical space between muscles.

20. The weighted article of clothing of claim 15, wherein at least one weight comprises a back weight cluster.

21. The weighted article of clothing of claim 15, wherein at least one weight comprises a thigh weight cluster.

22. The weighted article of clothing of claim 15, wherein at least one weight comprises an abdominal, buttocks, or trapezius weight cluster.

* * * * *